US005103894A

United States Patent [19]

Wilhelm et al.

[11] Patent Number: 5,103,894

[45] Date of Patent: Apr. 14, 1992

[54] PROCESS FOR THE TREATMENT OF CLAY-BONDED USED CASTING SAND

[75] Inventors: Ludwig Wilhelm, Engen, Fed. Rep. of Germany; Franz Satmer, Schaffhausen, Switzerland

[73] Assignee: Georg Fischer AG, Schaffhausen, Switzerland

[21] Appl. No.: 666,585

[22] Filed: Mar. 8, 1991

[30] Foreign Application Priority Data

Mar. 8, 1990 [CH] Switzerland ..... 748/90

[51] Int. Cl.[5] ..... B02C 19/12; B22C 5/18

[52] U.S. Cl. ..... 164/456; 164/5; 241/DIG. 10

[58] Field of Search ..... 241/DIG. 10; 164/5, 164/456

[56] References Cited

U.S. PATENT DOCUMENTS 3,312,403 4/1967 Zifferer ..... 241/DIG. 10 X
3,782,643 1/1974 Carpenter, Jr. ..... 241/DIG. 10 X
3,825,190 7/1974 Kauffman ..... 241/DIG. 10 X
3,857,201 12/1974 Jacob ..... 241/DIG. 10 X
4,177,952 12/1979 Rikker ..... 241/DIG. 10 X
4,274,360 6/1981 Hofmann et al. ..... 241/DIG. 10 X
4,436,138 3/1984 Kondo ..... 241/DIG. 10 X

FOREIGN PATENT DOCUMENTS 60-92041 5/1985 Japan ..... 164/456

*Primary Examiner*—J. Reed Batten, Jr.
*Attorney, Agent, or Firm*—Bachman & LaPointe

[57] ABSTRACT

The clay-bonded used casting sand is treated in a drum rotated about a horizontal axis by continuously feeding a sand additive to the drum in an amount sufficient to maintain the quantity of sand in the drum at about 26–40 percent by volume of the drum to compensate for the amount of shell material drawn off by pneumatic dust removal devices so as to maintain an optimal relationship between the volume of the drum in the quantity of sand in the drum over the entire period of treatment. The amount of sand fed to the drum may be controlled by the amount of current consumed by a motor used for rotating the drum.

5 Claims, No Drawings

PROCESS FOR THE TREATMENT OF CLAY-BONDED USED CASTING SAND

BACKGROUND OF THE INVENTION

The present invention relates to a process for the treatment of clay-bonded used casting sand wherein said used casting sand is regenerated for use as new sand.

Known in the prior art are processes for the treatment of clay-bonded used casting sand wherein said used casting sand is regenerated for reuse in place of new sand. The processes include treating the old sand in a drum which is rotated about a horizontal axis. During the rotation of the drum the old sand is entrained and separated into sand grains and shell material by the sand grains rubbing against one another under impact stress and shearing stress. The shell material is in the form of dust and the shell material is drawn off by means of a pneumatic dust-removal device to outside the drum.

In these known processes, during the drawing off of the shell dust which comprises a mixture of binding substances and additives, the weight of the used sand originally measured into the drum reduces with time by up to for example 25 wt. %. As is disclosed in German Patent Specification 290 94 08, the stirring and impact action of the old sand in the drum diminishes with the reduction of sand within the drum. Thus, the mutual rubbing action of the sand grains is greatly impaired by the net loss of weight of sand in the drum.

Naturally, it would be highly desirable to provide a process wherein the amount of sand within the drum is maintained at an optimum level with respect to the volume of the drum so as to insure optimum rubbing of the sand grains against each other.

Accordingly, it is a principal object of the present invention to provide a process for the treatment of clay-bonded used casting sand wherein an optimal relationship between the volume of the drum and the quantity of sand in the drum is maintained over the period of treatment of the clay-bonded used casting sand.

It is a further object of the present invention to provide a process wherein the shell of the used sand which is drawn off out of the drum during the batch treatment is compensated for in terms of weight and/or volume by additions of sand material.

Further objects and advantages of the present invention will appear hereinbelow.

SUMMARY OF THE INVENTION

In light of the present invention the foregoing objects and advantages are readily obtained.

The present invention is drawn to a process for the treatment of clay-bonded used casting sand wherein during the batch treatment of the used casting sand within a rotating drum wherein shell dust is drawn off by means of a pneumatic dust-removal device, a sand additive is fed to the drum in an amount sufficient to compensate for the amount of shell material drawn off by said pneumatic dust-removal device so as to maintain an optimal relationship between the volume of the drum and the quantity of the sand in the drum over the period of treatment. In accordance with the present invention, the volume of sand within the drum should be maintained within a ratio between about 1:2.5 to about 1:3.8 with respect to the volume of the drum in order to insure an optimal relationship as aforesaid. The sand added to the drum may be in the form of partially regenerated used sand from a previous batch treatment process, crushed sand cores, new sand and mixtures thereof. By maintaining the volume of sand within the drum as aforesaid the rubbing action of the sand grains is maintained at an optimal level thereby improving the overall efficiency of the treatment and regeneration process.

DETAILED DESCRIPTION

The present invention resides in improved process for the treatment of clay-bonded used sand and more specifically a process wherein during the treatment of the used casting sand a sand additive is fed to the treatment drum in an amount sufficient to compensate for the amount of shell material drawn off by the pneumatic dust-removal device employed in the process so as to maintain an optimal relationship between the volume of the drum and the quantity of sand in the drum over the period of treatment of the used sand. In accordance with the present invention the sand should be present in the drum in an amount of about between 26 to 40 percent by volume of the drum.

The added sand material can be new sand, partially regenerated used sand and/or crushed sand cores. Particularly useful is partially regenerated used sand which is recovered from a previous batch treatment.

In accordance with the present invention the sand may be added to the drum either in batch quantities or, more preferably, in a continuous manner so as to maintain the quantity of sand in the drum in the optimum relationship as set forth above. The measure for the addition of sand to the drum can be derived for example from the current consumption of an electric motor used to drive the drum. In addition, the weight of the sand to be treated in the drum can also be used to control the feed of sand to the drum.

By way of the process of the present invention constant optimal conditions for the old sand regeneration can be maintained so that the sand grains are released from their shells in an efficient and complete manner.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

We claim:

1. In a process for the treatment of clay-bonded used casting sand wherein said used casting sand is regenerated for reuse in place of new sand, said process including treating said old sand in a drum rotated about a horizontal axis wherein said old sand is entrained and separated into sand grains and shell material in the form of dust and said shell material is drawn off by means of a pneumatic dust-removal device to outside the drum, the improvement which comprises continuously feeding to said drum a sand additive in an amount sufficient to maintain the quantity of sand in the drum at about 26 to 40 volume percent of the drum to compensate for the amount of shell material drawn off by said pneumatic dust-removal device so as to maintain an optimal relationship between the volume of the drum and the quantity of sand in the drum over the period of treatment.

2. A process according to claim 1 wherein the sand additive is selected from the group consisting of partially regenerated used sand, crushed sand cores, new sand and mixtures thereof.

3. A process according to claim 1 wherein said sand additive is fed in batch quantities to said drum during the regeneration treatment.

4. A process according to claim 1 including providing an electric motor for rotating said drum and feeding said sand additive to said drum based on the current consumption of the motor.

5. In a process for the treatment of clay-bonded used casting sand wherein said used casting sand is regenerated for reuse in place of new sand, said process including treating said old sand in a drum rotated about a horizontal axis wherein said old sand is entrained and separated into sand grains and shell material in the form of dust and said shell material is drawn off by means of a pneumatic dust-removal device to outside the drum, the improvement which comprises feeding to said drum a sand additive in an amount sufficient to compensate for the amount of shell material drawn off by said pneumatic dust-removal device so as to maintain an optimal relationship between the volume of said drum and the quantity of sand in said drum over the period of treatment, including providing an electric motor for rotating said drum and feeding said sand additive to said drum based on the current consumption of the motor.

* * * * *